US005913356A

United States Patent [19]

Muramatsu

[11] Patent Number: 5,913,356

[45] **Date of Patent: *Jun. 22, 1999**

[54] CHILL VENT

[75] Inventor: Naokuni Muramatsu, Handa, Japan

[73] Assignee: NGK Insulators, Ltd, Japan

[ * ] Notice: This patent is subject to a terminal disclaimer.

[21] Appl. No.: 08/988,938

[22] Filed: Dec. 11, 1997

[30] Foreign Application Priority Data

Nov. 20, 1997 [JP] Japan ..... 9-319633

[51] Int. Cl.[6] ..... B22D 17/22

[52] U.S. Cl. ..... 164/305; 164/410; 249/135; 249/141; 425/812

[58] Field of Search ..... 164/305, 410; 425/420, 812; 249/135, 141

[56] References Cited

U.S. PATENT DOCUMENTS

| | | | |
|---|---|---|---|
| 4,154,285 | 5/1979 | Yamasaki | 164/305 X |
| 4,577,670 | 3/1986 | Moore | 164/305 X |

FOREIGN PATENT DOCUMENTS

| | | | |
|---|---|---|---|
| 61-38769 | 2/1986 | Japan . | |
| 63-180354 | 7/1988 | Japan | 164/305 |
| 3-254350 | 11/1991 | Japan | 164/305 |
| 4-13464 | 1/1992 | Japan | 164/305 |

*Primary Examiner*—J. Reed Batten, Jr.
*Attorney, Agent, or Firm*—Wall Marjama Bilinski & Burr

[57] ABSTRACT

A chill vent made of copper or copper alloy has a concave section and a convex section, each being subjected to removal of flat parting portions on both side surfaces, and a gas exhaust passage is formed over the entire width region. These gas exhaust passage portions have side surfaces and back surfaces which are enclosed in hard U-shaped guide frames. It is possible to effectively avoid occurrence of leakage or flashing of molten metal due to a plastic deformation of the chill vent by a mold fastening force applied upon assembly of a die-casting mold, which may occur when a copper or copper alloy having a superior cooling property as the material for chill vent.

7 Claims, 8 Drawing Sheets

CHILL VENT

BACKGROUND OF THE INVENTION

1. Field of the Invention

A permanent mold for die-casting light metals, such as aluminum alloy, zinc alloy, magnesium alloy and the like, is associated with a chill vent as means which functions when charging a molten metal into the mold cavity, for efficiently exhausting residual air and/or gas from inside to outside of the cavity, without spouting the molten metal or forming flashing.

The present invention relates to a chill vent used as gas exhausting means upon die-casting such light metals and specifically aims to improve the cooling efficiency of non-solidified molten metal entering into the chill vent to efficiently achieve an accelerated solidification.

2. Description of the Related Art

When air and/or gas is left in the cavity of the permanent mold at the time of die-casting, the air or gas tends to be dragged into the molten metal so as to cause gas holes and the like defects in the products and thereby degrade the product quality.

Therefore, as shown in FIG. 1, it is a conventional practice to provide a permanent mold with a chill vent 3 having a gas exhaust passage 2 which is communicated with the cavity 1 for pressure-casting a product, so that gas remaining in the cavity 1 can be discharged. In FIG. 1, reference numeral 4 designates a die casting permanent mold, and 5 a plunger for forcing out the molten metal.

In this instance, as shown in FIG. 1, the gas exhaust passage 2 is generally shaped in a zigzag-manner to ensure that, after the gas has been exhausted outside the chill vent, the molten metal is chilled in the passage 2 before it is flashed outside the permanent mold.

However, since the molten metal flows under a high-pressure condition, it is difficult to completely prevent the flashing of the molten metal even if the length of the passage 2 is increased by the zigzag shape.

In order to prevent flashing of molten metal with an improved reliability, it was considered necessary for the zigzag-shaped gas exhaust passage 2 to have a narrow gap d, or adopt a relatively steep angle θ of the zigzag-shape (waveform).

However, a narrow gap d causes the sectional area of the gas exhaust passage 2 to be decreased, while a steep angle θ causes the gas exhaust resistance to be increased. In any case, the gas exhaust efficiency is lowered and it becomes impossible to prevent formation of gas hole defects in the product.

Further, when the length L of the chill vent is increased, flashing of the molten metal can be prevented without narrowing the gap d of the zigzag-shaped gas exhaust passage 2 or adopting a steep angle θ of the zigzag-shape. However, such a measure results in increased size of the chill vent and difficulties for meeting with recent requirement for small-sized devices.

There have been proposed various types of chill vents which are capable of efficiently exhausting internal residual gas and preventing flashing of the molten metal, without increasing the size of the chill vent 3.

However, these proposals are still accompanied by problems that the structure becomes complicated and/or large-scaled auxiliary devices are required.

That is, in the former case, with reference to the basic structure such as that shown in FIG. 2, an elaborated arrangement is required such as a composite structure of telescopic elements 6 for the chill vent 3, which causes the entire chill vent to be complicated in shape and/or structure.

Further, in the latter case, with reference to a representative arrangement such as that shown in FIG. 3, it is necessary to arrange a gas suction device 7 adjacent to the chill vent 3 in order to further improve the gas exhaust efficiency. In this instance, although the size of the chill vent itself is not increased, the entire facility including the auxiliary devices is necessarily increased in size and troublesome and costly to manufacture.

In order to solve the above-mentioned problems, a proposal was made in Japanese Patent Application No. 9-57,572 wherein a chill vent is formed of a copper alloy having a superior thermal conductivity, and wherein a cooling pipe is provided adjacent to a zigzag-shaped gas exhaust passage (FIG. 4).

In this instance, it is possible to realize an improved cooling property of non-solidified molten metals entering into the chill vent, to thereby effectively prevent flashing of the molten metal without complicating the structure or increasing the size of the chill vent, with the size and shape maintained unchanged as before.

However, use of copper or copper alloy as the material for chill vent resulted in a new problem as explained below.

That is to say, in order to allow assembly of the permanent mold, the parting surfaces are designed such that the parting surface of the chill vent is 1/100 to 5/100 mm higher than the parting surface of the cavity mold.

Furthermore, when the permanent mold is assembled, a fastening force of typically several tons to 2,500 tons is applied depending upon the scale of die casting machine.

Conventionally, even when assembly of permanent mold is performed under the above-mentioned conditions, there had been raised no particular problem since both cavity mold and chill vent were made of SKD61 or the like having a high coefficient: of elasticity. When, however, a chill vent is made of copper or copper alloy having a low coefficient of elasticity, the chill vent is subjected to a plastic deformation by the applied fastening force. On the other hand, the cavity mold is applied with the fastening force subsequently to the chill vent and undergoes an elastic deformation since it is made of a material having a high coefficient of elasticity.

As a result, after die casting has been completed and the fastening force removed, only the parting surface of the chill vent is slightly depressed as compared to its peripheral portions, and this may cause leakage or flashing of molten metal.

DISCLOSURE OF THE INVENTION

The present invention has been accomplished in order to advantageously eliminate the above-mentioned problems. Thus, it is an object of the present invention to provide a chill vent which is made of copper or copper alloy having a superior cooling property, and which is yet capable of preventing deformation of the chill vent due to the fastening force applied upon assembly of the permanent mold, to thereby avoid leakage or flashing of molten metal.

The inventor conducted thorough studies and investigations on the behavior of deformation of the chill vent when a fastening force is applied, and arrived at recognition and findings as follows.

(1) The fastening force is applied only to flat parting portions on both side surfaces of the chill vent.

(2) Therefore, by eliminating such flat parting portions, the fastening force is not applied to the chill vent and is born by the cavity mold which is made of steel so that the plastic deformation of the chill vent can be avoided.

(3) Furthermore, the plastic deformation of the chill vent can also be avoided by a guide frame which is made of steel having a hardness similar to that of the cavity mold, and which is fitted over the outer peripheral portion of the chill vent.

The present invention is based on the abovementioned recognition and findings.

The present invention thus provides a chill vent comprising a zigzag-shaped gas exhaust passage which is formed at parting surfaces of a concave section and a convex section, and communicated with a cavity of a die casting permanent mold, wherein the concave section and the convex section of the chill vent are respectively formed with the gas exhaust passage over entire width regions thereof, and wherein the concave section and the convex section are made of copper or copper alloy, respectively.

According to a preferred embodiment of the present invention, each of the concave section and said convex section of the chill vent has both side surfaces and a back surface adjacent to the gas exhaust passage, wherein these surfaces are enclosed by a U-shaped hard guide frame.

In this instance, the U-shaped guide frame is advantageously made of SKD61 (JIS G4404, ASTM H13).

According to a preferred embodiment of the present invention, the chill vent has a main body for the gas exhaust passage which is made of a copper alloy including Be: 0.15 to 2.0 mass %, at least one composition selected from a group of Ni: 1.0 to 6.0 mass% and Co: 0.1 to 0.6 mass %, the balance being Cu and unavoidable impurities.

Such copper alloy may further include one or two compositions selected from a group of Al: 0.2 to 2.0 mass % and Mg: 0.2 to 0.7 mass %.

BEST MODE FOR CARRYING OUT THE INVENTION

The present invention will be more fully explained below, with reference to the accompanying drawings.

Figure 1:
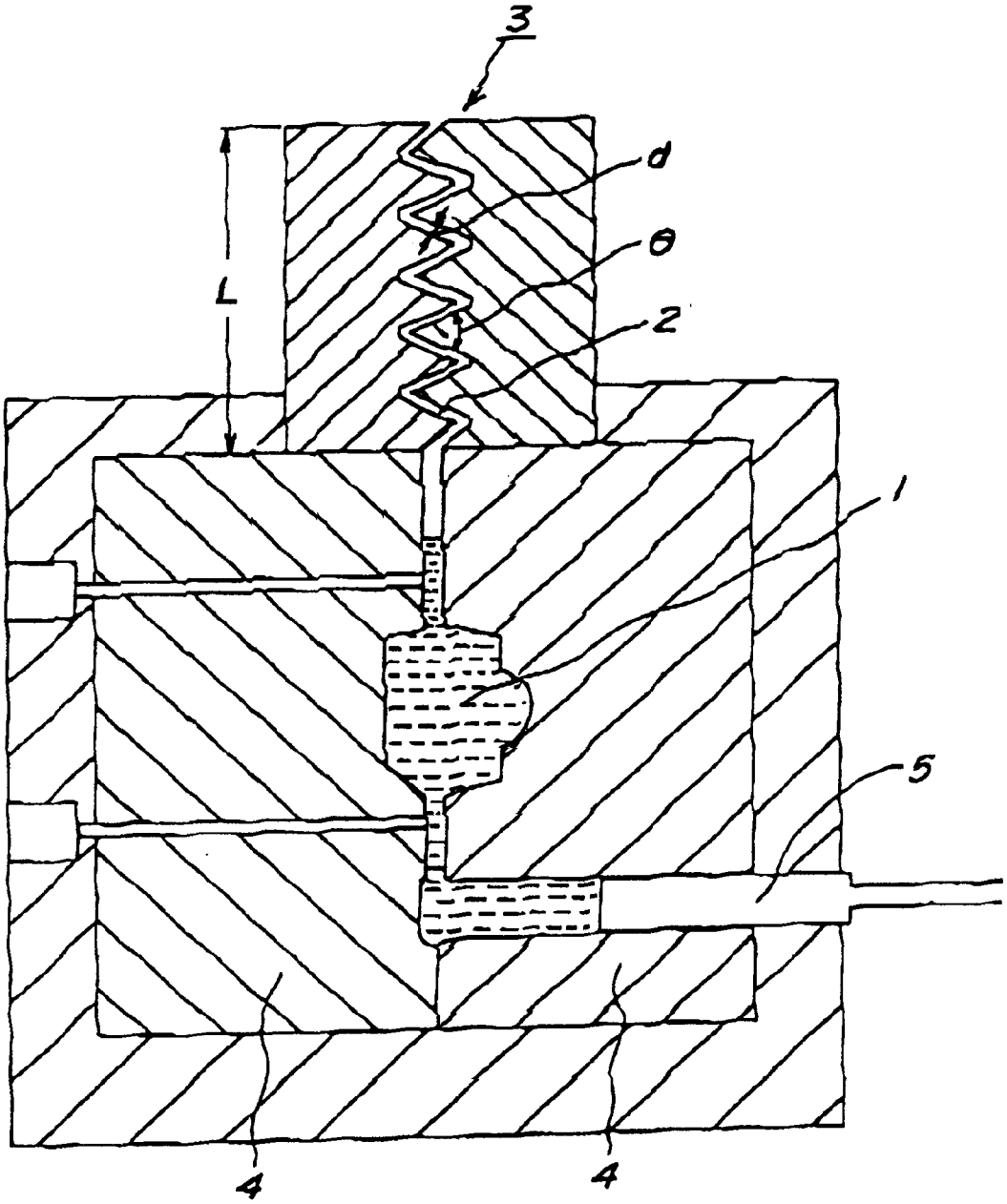
FIG. 1 is a view showing the structure of a general chill vent together with a mold.
Figure 2:
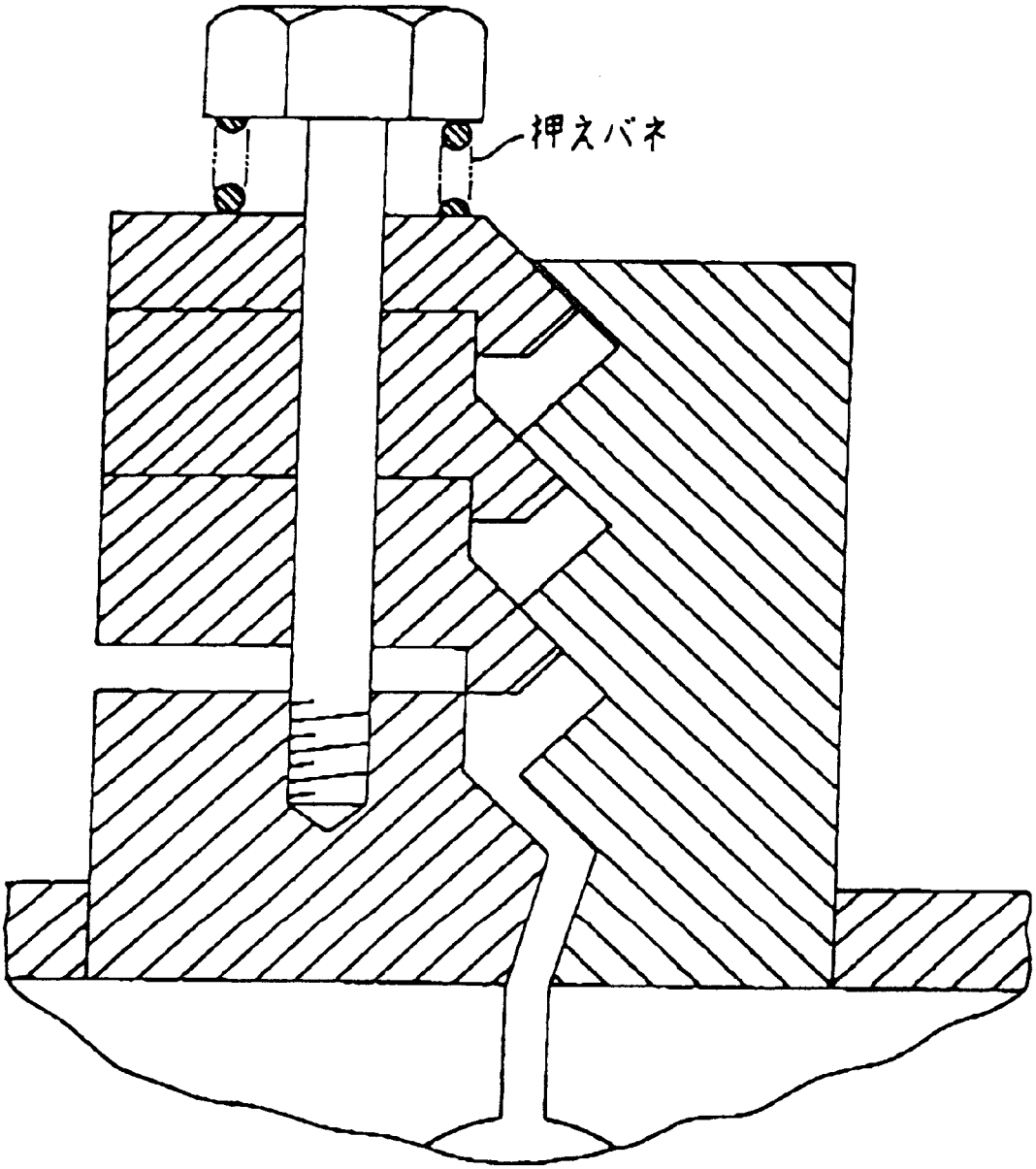
FIG. 2 is a view showing the structure of a conventional chill vent with a complicated arrangement of divided telescopic elements.
Figure 3:
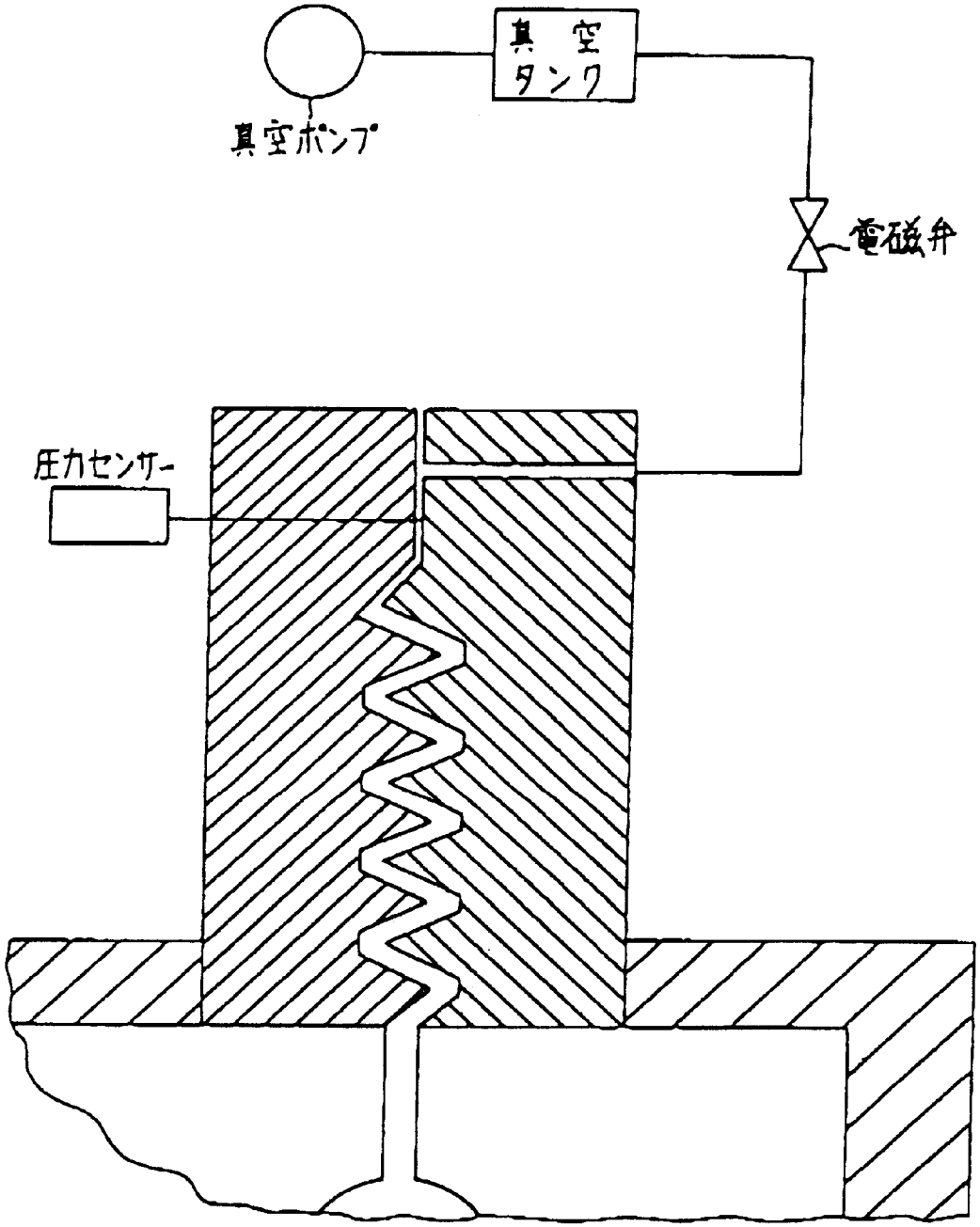
FIG. 3 is a view showing the structure of another conventional chill vent with a number of auxiliary devices.
Figure 4:
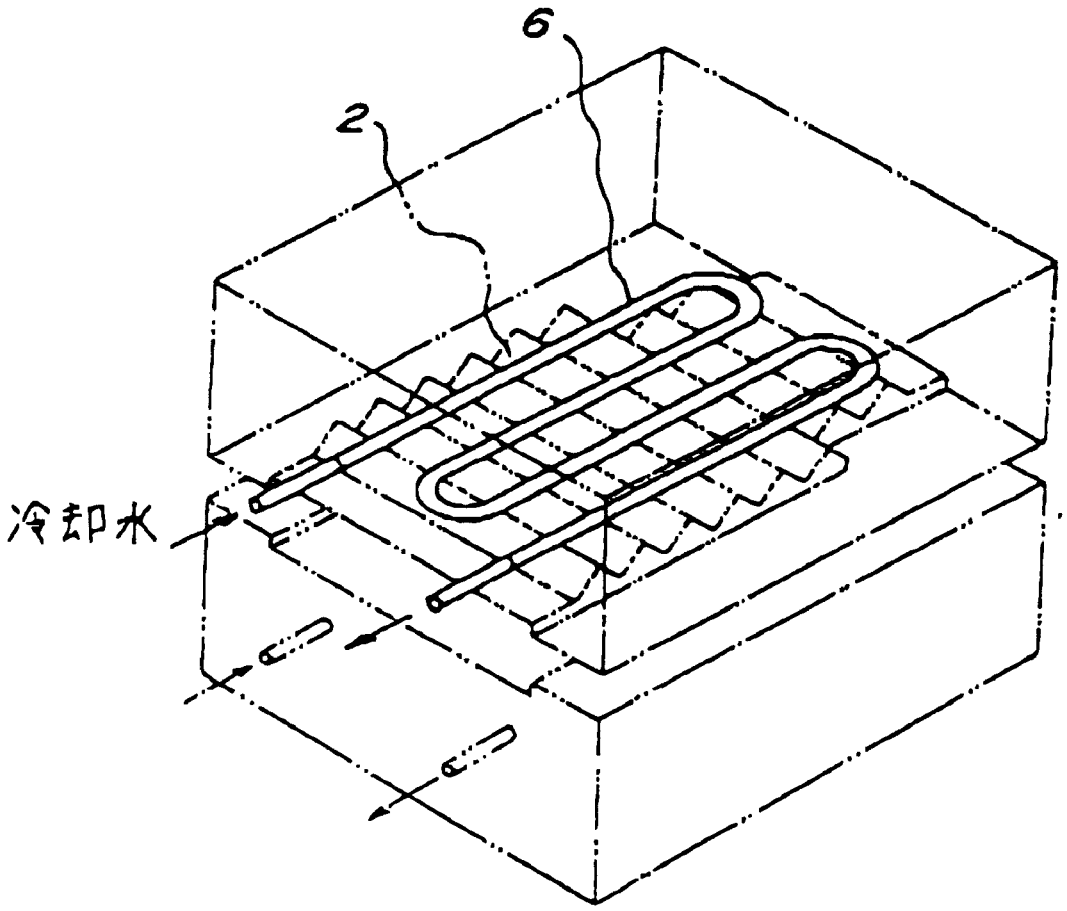
FIG. 4 is a view showing a construction of a chill vent which is provided with cooling pipes.
Figure 5A:
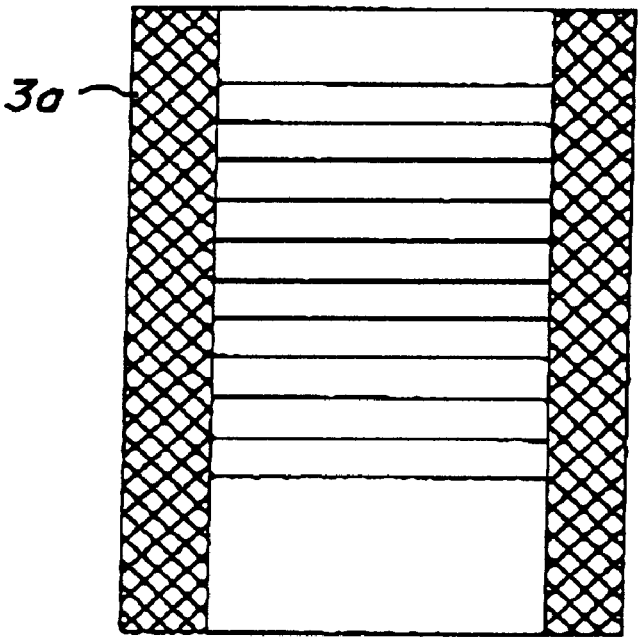
FIG. 5 is a view showing a concave shape of a conventional chill vent.
Figure 5B:
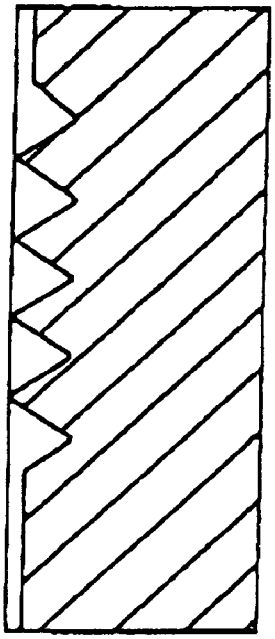
Figure 5C:
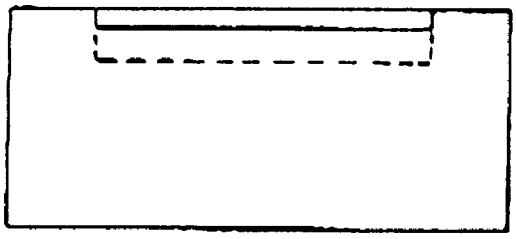
Figure 6A:
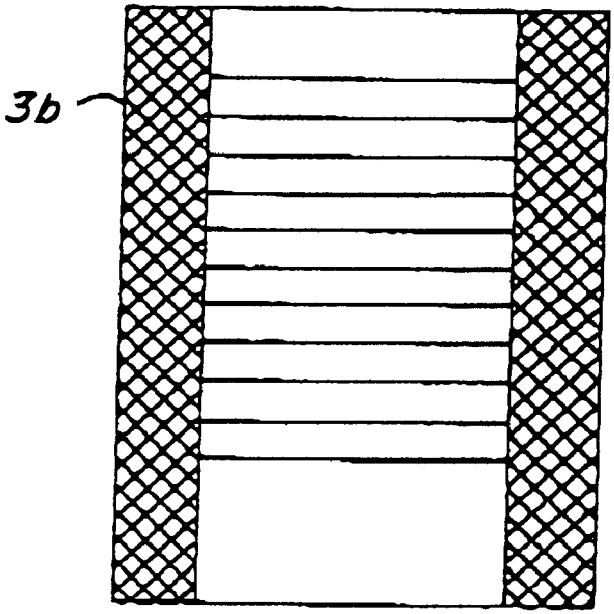
FIG. 6 is a view showing a convex shape of a conventional chill vent.
Figure 6B:
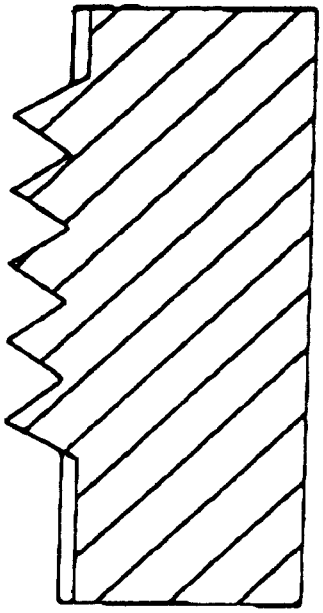
Figure 6C:
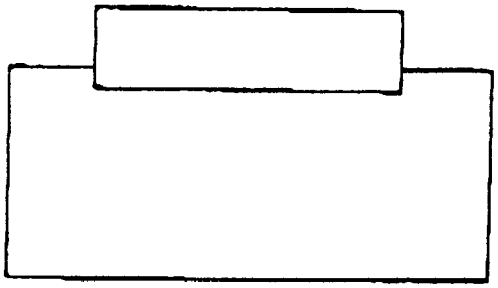

There are shown in FIGS. 5 and 6 the shapes of concave section 2*a* and convex section 2*b* of a conventional chill vent made of a copper alloy. In these figures, (a) are plan views, (b) are sectional views and (c) are bottom views.

In these figures, cross-hatched regions denoted by reference numerals 3*a* and 3*b* correspond to those portions which have been subjected to a plastic deformation due to a mold fastening force.

As shown in these figures, it is only flat parting regions on both sides of the chill vent, which undergo plastic deformation due to the mold fastening force.

Figure 7A:
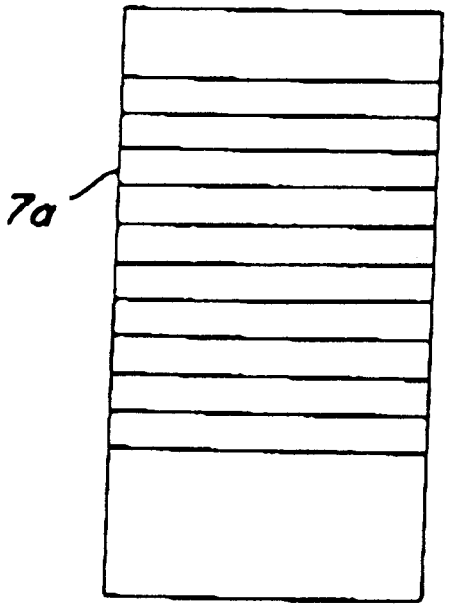
FIG. 7 is a view showing a concave shape of a chill vent according to the present invention.
Figure 7B:
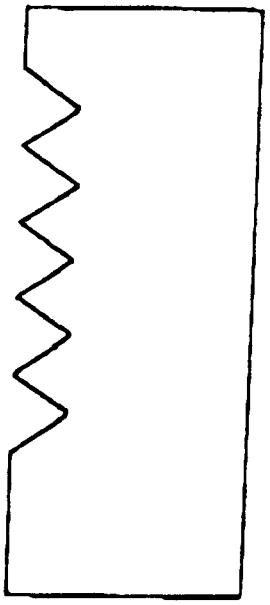
Figure 8A:
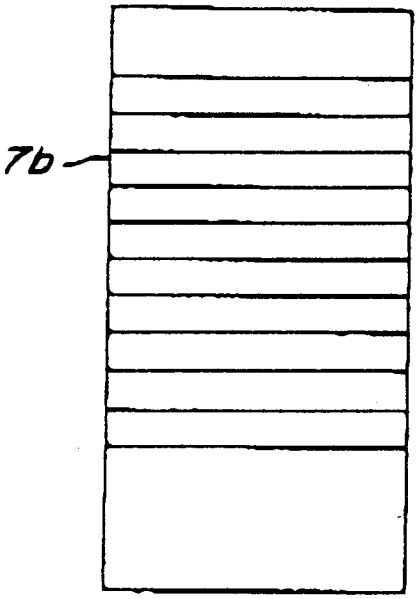
FIG. 8 is a view showing a convex shape of a chill vent according to the present invention.
Figure 8B:
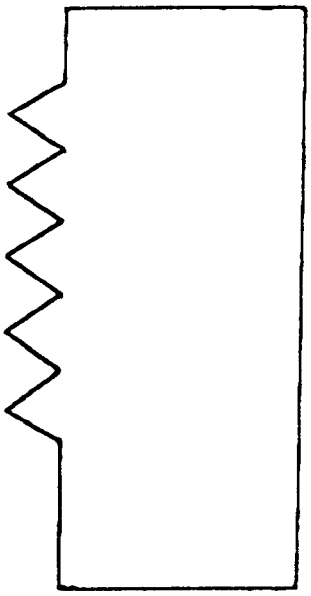

Thus, as shown in FIGS. 7 and 8, the flat parting regions conventionally applied with the mold fastening force have been removed, such that the mold fastening force are now born by steel cavity regions on both side of the chill vent. As a result, it was made possible to completely avoid plastic deformation of the chill vent and effectively prevent leakage or flashing of molten metal.

Figure 9A:
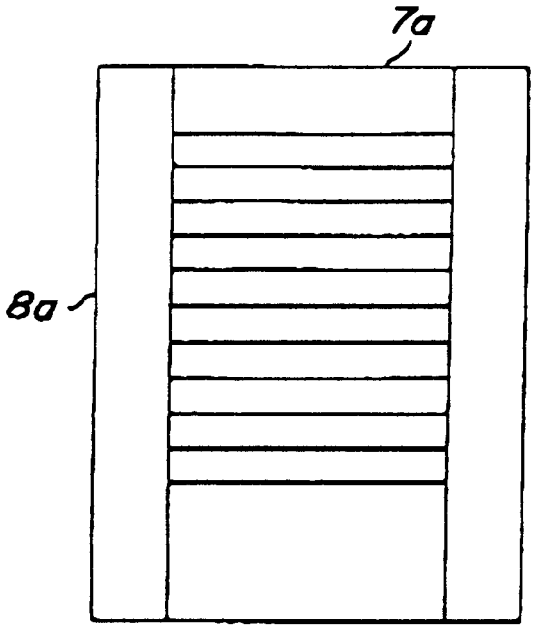
FIG. 9 is a view showing a concave shape of a chill vent according to another embodiment of the present invention.
Figure 9B:
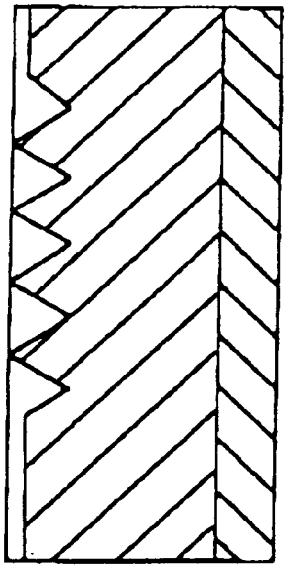
Figure 10A:
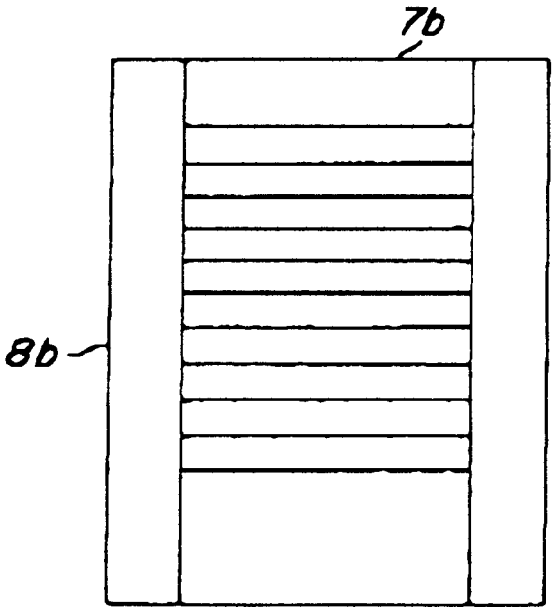
FIG. 10 is a view showing a convex shape of a chill vent according to the same embodiment of the present invention.
Figure 10B:
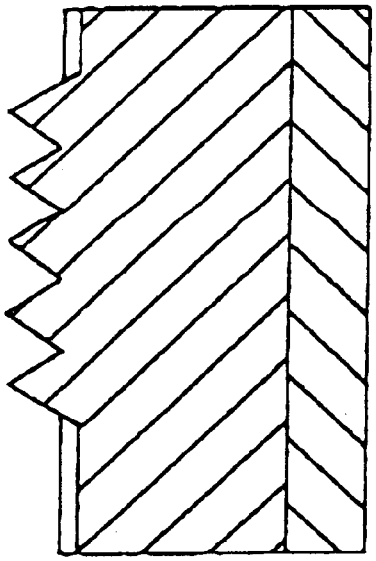

Furthermore, as shown in FIGS. 9 and 10, the concave section and convex section of the chill vent have been fitted with U-shaped steel guide frames 8*a*, 8*b* having a hardness which is substantially the same as that of the cavity portion, so as to enclose both side surfaces and back surfaces of gas exhaust passage portions 7*a*, 7*b*. In this instance, the mold fastening force is born by the U-shaped steel guide frames 8*a*, 8*b*, making it possible to completely avoid plastic deformation of the chill vent and effectively prevent leakage or flashing of molten metal.

With such an arrangement, the cavity portion and the guide frames are made of the same material, so that the control of fitting tolerance becomes easier as compared to the embodiment shown in FIG. 6.

In the above-mentioned complex-type chill vent, from the viewpoint of preservation of the gas exhaust passage despite application of a high mold fastening force, it is preferred that the U-shaped guide frames have a thickness which is approximately 5–30 mm.

Incidentally, the copper alloy chill vent and the steel guide frames are fixedly connected to each other by bolts or the like, under appropriate clearance determined in consideration of temperature increase during use. Also, the control of fitting tolerance between the copper alloy chill vent and the cavity portion, or between the guide frames and the cavity portion, is within the level of ordinary skill in the art, and there should be no difficulties in this respect.

According to the present invention, the gas exhaust passage portion can be suitably made of copper, and various copper alloys, such as beryllium-copper alloy, chromium-copper alloy, brass, bronze, phosphorous bronze, aluminum-bronze alloy, and Corson alloy. Specifically, an advantageous material comprises a copper alloy including Be: 0.15 to 2.0 mass %, at least one composition selected from a group of Ni: 1.0 to 6.0 mass % and Co: 0.1 to 0.6 mass %, the balance being Cu and unavoidable impurities. Optionally, the copper alloy may further include one or two compositions selected from a group of Al: 0.2 to 2.0 mass % and Mg: 0.2 to 0.7 mass %.

This is because the alloy composition explained above serves to realize a material which is suitable for chill vent, having a Rockwell hardness HRB of not less than 90, and a thermal conductivity of not less than 80 W/mΨK, and which is not readily dissolved by light metal alloys.

In such copper alloy, the contents of the components are limited to the above-mentioned ranges, respectively, for the grounds as follows.

Be: 0.15 to 2.0 Mass %

Be is useful to form a NiBe or CoBe compound by being bonded with Ni or Co, which effectively contributes to the improvement in strength, hence, hardness of the material, and also useful to form an oxide film. If Be is added by an amount less than 0.15 mass %, the effect of its addition is not significant. On the other hand, if the content of Be is more than 2.0 mass %, a further improvement in strength is not expected and the addition becomes disadvantageous in term of cost consideration. Therefore, it is preferred that Be is added in the range of 0.15 to 2.0 mass %.

Ni: 1.0 to 6.0 Mass %

Ni is useful to form a NiBe or $Ni_3Al$ compound by being bonded with Be or Al, which effectively contributes to the improvement in strength, hence, hardness of the material, and also useful to form an oxide film. If Ni is added by an amount less than 1.0 mass %, the effect of its addition is not significant. On the other hand, if the content of Ni is more than 6.0 mass %, the melting point of the alloy is increased and welding repair works become difficult. Therefore, it is preferred that Ni is added in the range of 1.0 to 6.0 mass %.

Co: 0.1 to 0.6 Mass %

Co is useful to form a CoBe compound by being bonded with Be, as is the case with Ni, which effectively contributes to the improvement in strength of the material. If Co is added by an amount less than 0.1 mass %, the effect of its addition is not significant. On the other hand, if the content of Co is more than 0.6 mass %, the manufacturing properties (hot workability) when manufacturing the copper alloy is degraded. Therefore, it is preferred that Co is added in the range of 0.1 to 0.6 mass %.

Al: 0.2 to 2.0 Mass %

Al is useful to form a $Ni_3Al$ compound by being bonded with Ni, which effectively contributes to the improvement in strength, and is also useful to form an oxide film and adjust the thermal conductivity. If Al is added by an amount less than 0.2 mass %, the effect of its addition is not significant. On the other hand, if the content of Al is more than 2.0 mass %, the thermal conductivity becomes too low. Therefore, it is preferred that Al is added in the range of 0.2 to 2.0 mass %.

Mg: 0.2 to 0.7 Mass %

Mg is useful to improve the hardness and form an oxide film. If Mg is added by an amount less than 0.2 mass %, the effect of its addition is not significant. On the other hand, if the content of Mg is more than 0.7 mass %, the manufacturing property (castability) when manufacturing the copper alloy is degraded. Therefore, it is preferred that Mg is added in the range of 0.2 to 0.7 mass %.

From the above considerations, the copper alloy which is not less than 90 in Rockwell hardness HRB and not less than 30 W/m•K in thermal conductivity is prepared by adding to copper an appropriate amount of elements having a strong oxidization property, such as Be, Ni, Co, Al, Mg. By using the above copper alloy as a material for chill vent, it is possible to obtain a die casting chill vent which is capable of effectively exhausting air and gasses outside the mold without being dissolved by light metal alloys, and of effectively chilling the non-solidified molten metal before flashing of the molten metal occurs.

On the other hand, as for the U-shaped guide frames, any material can be used provided that it is as hard as the cavity portion. However, a preferred material is SKD61.

EXAMPLES

There have been prepared chill vents each having a concave section and a convex section of conventional shapes shown in FIGS. 5 and 6 explained above, with a copper alloy having an HRC hardness of 20 (HRB: approximately 98) and a thermal conductivity of 200 W/m•K, and with SKD61 (HRC: approximately 45, thermal conductivity: 35 W/m•K). These chill vents were used in a 2,500-ton die casting machine to perform casting of aluminum alloy (equivalent to ADC 12).

In this instance, the chill vents were made to have parting surfaces which are 2/100 mm higher than those for the cavity portions.

Similarly, there have been prepared a chill vent according to the first embodiment, having a concave section and a convex section of the shapes shown in FIGS. 7 and 8, respectively, and anther chill vent according to the second embodiment, having a concave section and a convex section of the shapes shown in FIGS. 9 and 10, respectively, to perform casting with the same machine.

In either case, the gas exhaust passage portion is made of the same copper material (Be: 2.0 mass %, Ni: 1.5 mass %, Co: 0.5 mass %, Mg: 0.5 mass %, the balance:Cu, HRC hardness: 20, thermal conductivity: 200 W/m•K), as that explained above, and the U-shaped guide frames are made of the same SKD61 (HRC: approximately 45, thermal conductivity: 35 W/m•K) to have a thickness of 10 mm.

These chill vents were assembled into a permanent mold which is capable of simultaneously casting three products, and arranged such that comparison and evaluation can be made at the same time as casting is performed under the same conditions.

The results of the comparison and evaluation are shown in Table 1.

TABLE 1

| No. | Material of chill vent | Thermal conductivity (W/m · K) | Hardness (HRC) | Number of shots | Chilled height (mm) | Occurrence of seizures | Deformation at parting portions | Flashing | Remarks |
|---|---|---|---|---|---|---|---|---|---|
| 1 | SKD 61 (comparative example 1) | 35 | 45 | 27 | 150 | frequent | none | none | evaluation stopped on the way due to frequent seizures |
| 2 | only copper alloy (comparative example 2) | 200 | 20 | 16 | 90 | none | deformed | occurrence found | evaluation stopped on the way due to deformation |

TABLE 1-continued

| No. | Material of chill vent | Thermal conductivity (W/m · K) | Hardness (HRC) | Number of shots | Chilled height (mm) | Occurrence of seizures | Deformation at parting portions | Flashing | Remarks |
|---|---|---|---|---|---|---|---|---|---|
| 3 | only copper alloy (inventive example 1) | 200 | 20 | 774 | 90 | none | — — | none | no problems |
| 4 | copper alloy for passage portion and SKD61 for guide frames (inventive example 2) | 200 (for passage portion) | 20/45 | 774 | 90 | none | none | none | no problems |

Performed with a 2500-ton die-casting machine.
Simultaneous evaluation with die-casting a mold capable of three aluminum alloy products equivalent to ADC12.
Chilled height refers to an average height where molten aluminum is stopped after being cooled and solidified.
Seizures were visually observed by presence of solidified slag remaining in the chill vent when the mold is opened.
The deformation at the parting portions was visually observed by occurrence of flashing due to leakage of molten metal.

As can be appreciated from Table 1, by using the chill vent according to the present invention, the chilled height can be reduced nearly by half, as compared to conventional steel chill vent, proper chill vent functions can be achieved without causing seizure of solidified slag, and occurrence of leakage or flashing of molten metal can be avoided even under a fastening force of the die-casting machine of 2500-ton class.

Industrial Susceptibility

As described above, according to the present invention, it is possible to avoid occurrence of leakage or flashing of molten metal due to a plastic deformation of the chill vent, which may occur when a copper or copper alloy having a low coefficient of elasticity is used as the material for chill vent.

What is claimed is:

1. A chill vent comprising a zigzag-shaped gas exhaust passage which is formed at parting surfaces of a concave section and a convex section, and communicated with a cavity of a die casting permanent mold, wherein said concave section and said convex section of said chill vent are respectively formed with said gas exhaust passage over entire width regions thereof, and said concave section and said convex section are made of copper or copper alloy, respectively.

2. A chill vent according to claim 1, wherein each of said concave section and said convex section of said chill vent has both side surfaces and a back surface adjacent to a portion of said gas exhaust passage, said surfaces being enclosed by a U-shaped hard guide frame.

3. A chill vent according to claim 2, wherein said U-shaped guide frame is made of SKD61.

4. A chill vent according to claim 1, wherein said chill vent has a passage portion made of a copper alloy comprising 0.15 to 2.0 mass % Be, at least one element selected from the group consisting of 1.0 to 6.0 mass % Ni and 0.1 to 0.6 mass % Co, and the balance being Cu and unavoidable impurities.

5. A chill vent according to claim 4, wherein said copper alloy further comprises at least one element selected from the group consisting of 0.2 to 2.0 mass % Al, and 0.2 to 0.7 mass % Mg.

6. A chill vent according to claim 2, wherein said chill vent has a passage portion made of a copper alloy comprising 0.15 to 2.0 mass % Be, at least one element selected from the group consisting of 1.0 to 6.0 mass % Ni and 0.1 to 0.6 mass % Co, and the balance being Cu and unavoidable impurities.

7. A chill vent according to claim 6, wherein said copper alloy further comprises at least one element selected from the group consisting of 0.2 to 2.0 mass % Al, and 0.2 to 0.7 mass % Mg.

* * * * *